US006266977B1

(12) United States Patent
Howard et al.

(10) Patent No.: US 6,266,977 B1
(45) Date of Patent: Jul. 31, 2001

(54) NITROGEN REFRIGERATED PROCESS FOR THE RECOVERY OF $C_{2+}$ HYDROCARBONS

(75) Inventors: Lee Jarvis Howard, Pikeville; Howard Charles Rowles, Center Valley; Mark Julian Roberts, Kempton, all of PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 09/552,927

(22) Filed: Apr. 19, 2000

(51) Int. Cl.[7] ..... F25J 1/00

(52) U.S. Cl. ..... 62/623; 62/627; 62/912; 62/935

(58) Field of Search ..... 62/623, 627, 912, 62/935

(56) References Cited

U.S. PATENT DOCUMENTS

| | | | | |
|---|---|---|---|---|
| 3,511,058 | | 5/1970 | Becker | 62/9 |
| 4,272,269 | | 6/1981 | Hammond et al. | 62/17 |
| 4,584,006 | | 4/1986 | Apffel | 62/30 |
| 4,617,039 | | 10/1986 | Buck | 62/26 |
| 4,707,170 | | 11/1987 | Ayres et al. | 62/24 |
| 4,714,487 | | 12/1987 | Rowles | 62/24 |
| 4,749,393 | * | 6/1988 | Rowles et al. | 62/627 |
| 4,752,312 | | 6/1988 | Prible | 62/25 |
| 4,895,584 | | 1/1990 | Buck et al. | 62/29 |
| 4,921,514 | * | 5/1990 | Rowles et al. | 62/627 |
| 5,019,143 | | 5/1991 | Mehrta | 62/17 |
| 5,275,005 | | 1/1994 | Campbell et al. | 62/24 |
| 5,287,703 | | 2/1994 | Bernhard et al. | 62/24 |
| 5,377,490 | * | 1/1995 | Howard et al. | 62/627 |
| 5,461,870 | | 10/1995 | Paradowski | 62/11 |
| 5,483,806 | | 1/1996 | Miller et al. | 62/402 |
| 5,502,971 | | 4/1996 | McCarthy et al. | 62/20 |
| 5,520,724 | | 5/1996 | Bauer et al. | 95/169 |
| 5,555,748 | | 9/1996 | Campbell et al. | 62/621 |
| 5,568,737 | | 10/1996 | Campbell et al. | 62/621 |
| 5,768,912 | | 6/1998 | Dubar | 62/613 |
| 6,041,620 | | 3/2000 | Olszewski et al. | 62/612 |
| 6,041,621 | | 3/2000 | Olszewski et al. | 62/613 |
| 6,065,305 | | 5/2000 | Arman et al. | 62/613 |

FOREIGN PATENT DOCUMENTS

| | | | |
|---|---|---|---|
| WO97/13109 | 4/1997 | (WO) | F25J/1/02 |

OTHER PUBLICATIONS

Muller, K., et al., Natural–Gas Liquefaction by an Expansion–Turbine Mixture Cycle, Chemical Economy & Engineering Review, Oct. 1976 vol. 8, No. 10 (No.99).

* cited by examiner

*Primary Examiner*—Ronald Capossela
(74) *Attorney, Agent, or Firm*—John M. Fernbacher

(57) ABSTRACT

$C_2$ and $C_3$ hydrocarbons, particularly ethylene and propylene, are recovered from refinery or petrochemical plant gas mixtures by cooling and fractionating a feed gas mixture containing these hydrocarbons and lighter components. Refrigeration for the process is provided by a closed-loop gas expander refrigeration process cycle which preferably uses nitrogen as the recirculating refrigerant. Cooling and fractionation may be effected in a dephlegmator.

15 Claims, 2 Drawing Sheets

NITROGEN REFRIGERATED PROCESS FOR THE RECOVERY OF $C_2^+$ HYDROCARBONS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The recovery of olefins such as ethylene and propylene from gas mixtures is an economically important but highly energy intensive process in the petrochemical industry. These gas mixtures are produced by hydrocarbon pyrolysis in the presence of steam, commonly termed thermal cracking, or can be obtained as offgas from fluid catalytic cracking and fluid coking processes. Cryogenic separation methods are commonly used for recovering these olefins and require large amounts of refrigeration at low temperatures.

Olefins are recovered by condensation and fractionation from feed gas mixtures which contain various concentrations of hydrogen, methane, ethane, ethylene, propane, propylene, and minor amounts of higher hydrocarbons, nitrogen, and other trace components. Methods for condensing and fractionating these olefin-containing feed gas mixtures are well-known in the art. Refrigeration for condensing and fractionation is commonly provided at successively lower temperature levels by ambient cooling water, closed cycle propylene and ethylene systems, and work expansion or Joule-Thomson expansion of pressurized light gases produced in the separation process. Recent improvements in cryogenic olefin recovery methods have reduced energy requirements and increased recovery levels of ethylene and/or propylene.

Many methods have been proposed to provide refrigeration to cryogenic separation processes for the recovery of $C_2$ or $C_3$ and heavier hydrocarbons. These methods include work expansion of the feed gas or the light residue gas, conventional single-fluid or cascade vapor compression refrigeration, mixed refrigerant, and Joule-Thomson expansion refrigeration. Other processes utilize absorption for the recovery of $C_2$ or $C_3$ and heavier hydrocarbons, which typically reduces the amount of refrigeration required for the separation process.

U.S. Pat. Nos. 5,568,737, 5,555,748 and 4,752,312 describe processes utilizing work expansion of the feed gas to provide refrigeration for recovery of $C_2^+$ or $C_3^+$ hydrocarbons from natural gas or refinery gas streams. U.S. Pat. Nos. 5,275,005, 4,895,584 and 4,617,039 describe similar processes where a conventional propane or other vapor recompression refrigeration system is used to supplement the refrigeration provided by work expansion of the feed gas. These processes require relatively high feed gas pressure, typically 500 to 1000 psia, and relatively low $C_2$ content in the feed in order to provide sufficient refrigeration for high $C_2$ recovery (90% or more). They are generally more suitable for $C_3$ recovery which requires warmer refrigeration than that required for $C_2$ recovery. U.S. Pat. No. 4,714,487 describes a similar process utilizing work expansion of the light residue gas to provide refrigeration for recovery of $C_3^+$ hydrocarbons.

A conventional cascade vapor compression refrigeration system is disclosed in U.S. Pat. No. 5,502,971 which utilizes an ethylene/propylene system to provide refrigeration for recovery of $C_2^+$ hydrocarbons from a refinery off-gas stream. This type of refrigeration is used in essentially all ethylene plants to recover ethylene and heavier hydrocarbons from cracked gas. This type of cascade system can provide refrigeration efficiently at temperature levels as low as −150° F. but requires two refrigerant compressors and multiple refrigerant drums.

Joule-Thomson expansion and revaporization of separated $C_2^+$ hydrocarbons to provide refrigeration for recovery of those hydrocarbons from a cracked gas is described in U.S. Pat. No. 5,461,870. This process is energy efficient but requires that the hydrocarbon product be recovered as a vapor at relatively low pressure in order to provide refrigeration at the low temperature level that is necessary for the separation.

U.S. Pat. Nos. 5,329,779, 5,287,703, 4,707,170 and 4,584,006 utilize various forms of mixed refrigerant systems to provide refrigeration for recovery of $C_2$ or heavier hydrocarbons from various hydrocarbon containing streams. These processes utilize a single refrigerant compressor to provide refrigeration over a wide temperature range but require multiple refrigerant drums and complex refrigerant make-up systems.

Processes utilizing absorption for the recovery of $C_2^+$ or $C_3^+$ hydrocarbons from cracked gas, refinery gas, or natural gas is disclosed in U.S. Pat. Nos. 5,520,724, 5,019,143 and 4,272,269. The light hydrocarbons are absorbed in a heavier solvent, usually a $C_5$ or heavier hydrocarbon, in an absorption column and stripped in a separate column to recover the light product and regenerate the heavy solvent. Conventional vapor recompression refrigeration is usually required to refrigerate the solvent, typically to about −40° F., in order to achieve high $C_2$ recovery.

Nitrogen recycle refrigeration systems have been used in cryogenic air separation plants to provide very low temperature refrigeration (−280 to −320° F.) for the production of liquid oxygen and liquid nitrogen products (see U.S. Pat. Nos. 5,231,835, 4,894,076, and 3,358,460). Nitrogen recycle refrigeration systems have not been used, however, for $C_2$ and $C_3$ hydrocarbon recovery at warmer temperatures (−50 to −250° F.).

The cryogenic separation methods described above for recovering $C_2^+$ and $C_3^+$ hydrocarbons require large amounts of refrigeration at low temperatures. It is desirable to reduce the energy consumed for these refrigeration requirements by utilizing new or improved refrigeration processes which can be installed at reasonable capital cost. The process of the present invention, which is described below and defined by the claims which follow, utilizes a low-cost and energy-efficient method to supply such refrigeration.

BRIEF SUMMARY OF THE INVENTION

The invention is a process for the separation of a feed gas mixture comprising hydrogen and one or more components selected from the group consisting of ethane, ethylene, propane, and propylene. The process comprises (a) cooling the feed gas mixture; (b) introducing the resulting cooled feed gas mixture into a cooling and fractionation zone wherein the cooled feed gas mixture is further cooled and fractionated to yield a light overhead gas stream and a liquid product stream enriched in one or more components selected from the group consisting of ethane, ethylene, propane, and propylene; and (c) providing at least a portion of the refrigeration required in (a) and (b) by indirect heat exchange with a cold refrigerant stream generated by work expanding a pressurized gaseous refrigerant stream in a closed-loop gas expander refrigeration process. The cooling and fractionation of the cooled feed gas mixture in (b) can be performed in a dephlegmator.

A portion of the refrigeration required in the cooling and fractionation zone of (b) can be provided by indirect heat exchange with the light overhead gas stream of (b) to yield a warmed light overhead gas stream. A portion of the refrigeration required for cooling the feed gas mixture in (a) can be provided by indirect heat exchange with the warmed light overhead gas stream. A portion of the refrigeration required for cooling the feed gas mixture can be provided by indirect heat exchange by at least partially vaporizing the liquid product stream of (b).

The pressurized gaseous refrigerant stream of (c) can be provided in the closed loop gas expander refrigeration process which comprises compressing a warmed refrigerant gas resulting from providing at least a portion of the refrigeration required in (a) and (b), cooling the resulting compressed refrigerant gas, and work expanding the resulting cooled compressed refrigerant gas to provide the cold refrigerant stream of (c). The refrigerant gas can comprise nitrogen, methane, a mixture of nitrogen and methane, or air. A portion of the work required to compress the warmed refrigerant gas can be provided by the work expanding of the resulting cooled compressed refrigerant gas.

A portion of the refrigeration required for cooling the resulting compressed refrigerant gas can be provided by indirect heat exchange by at least partially vaporizing the liquid product stream of (b).

At least a portion of the refrigeration required in (a) and (b) can be provided in a closed-loop gas expander refrigeration process which comprises (1) compressing a warmed refrigerant gas resulting from providing at least a portion of the refrigeration required in (a) and (b); (2) cooling the resulting compressed refrigerant gas to yield a cooled refrigerant gas; (3) further cooling a first portion of the cooled refrigerant gas to yield a further cooled refrigerant gas which is work expanded and used to provide a portion of the refrigeration required in (b), thereby yielding a partially warmed refrigerant gas; and (4) work expanding a second portion of the cooled refrigerant gas to yield a cooled expanded refrigerant gas, combining the cooled expanded refrigerant gas with the partially warmed refrigerant gas of (3), and utilizing the resulting combined refrigerant gas to provide a portion of the refrigeration required to cool the feed gas mixture in (a), thereby providing the warmed refrigerant gas of (1).

The method may further comprise introducing at least a portion of the liquid product stream of (b) into a stripping column and withdrawing therefrom a bottoms stream further enriched in one or more components selected from the group consisting of ethane, ethylene, propane, and propylene and an overhead stream enriched in hydrogen. The overhead stream can be combined with the cooled feed gas mixture prior to the cooling and fractionation in (b).

Boilup vapor for the stripping column can be provided at least in part by vaporizing liquid from the bottom of the column by indirect heat exchange with the feed gas mixture, thereby cooling the feed gas mixture. Boilup for the stripping column can be provided at least in part by vaporizing liquid from the bottom of the column by indirect heat exchange with a portion of the pressurized gaseous refrigerant stream, thereby cooling the portion of the pressurized gaseous refrigerant stream.

The feed gas mixture also may include one or more lower-boiling components selected from the group consisting of methane, carbon monoxide, carbon dioxide, and nitrogen.

DETAILED DESCRIPTION OF THE INVENTION

The present invention is a method for the recovery of $C_2$ and/or $C_3$ hydrocarbons, particularly ethylene and propylene, from refinery or petrochemical plant gas mixtures containing these components with one or more lighter, lower-boiling components including hydrogen. A dephlegmator or other cooling and fractionation method is utilized to condense and separate the feed gas to yield $C_2$-enriched and/or $C_3$-enriched intermediate product streams for optional further separation and purification. Refrigeration for the process is provided at least in part by a closed-loop gas expander refrigeration process cycle which preferably uses nitrogen as the recirculating refrigerant. The closed loop nitrogen expander process cycle utilizes a compressor to compress the nitrogen refrigerant to a suitable pressure and utilizes one or more turbo expanders, which may be compressor loaded (companders), to work expand the compressed nitrogen to one or more temperature levels to provide at least a portion of the refrigeration required for the separation process. The hydrocarbon product may be recovered in gaseous or liquid form. The separation process may include a stripping column or distillation column to remove lighter components from the product and/or a distillation column to remove heavier components from the product. The nitrogen may be compressed to two or more pressure levels and may be expanded to two or more pressure levels, if this is desirable to provide a more energy-efficient refrigeration system.

Figure 1:
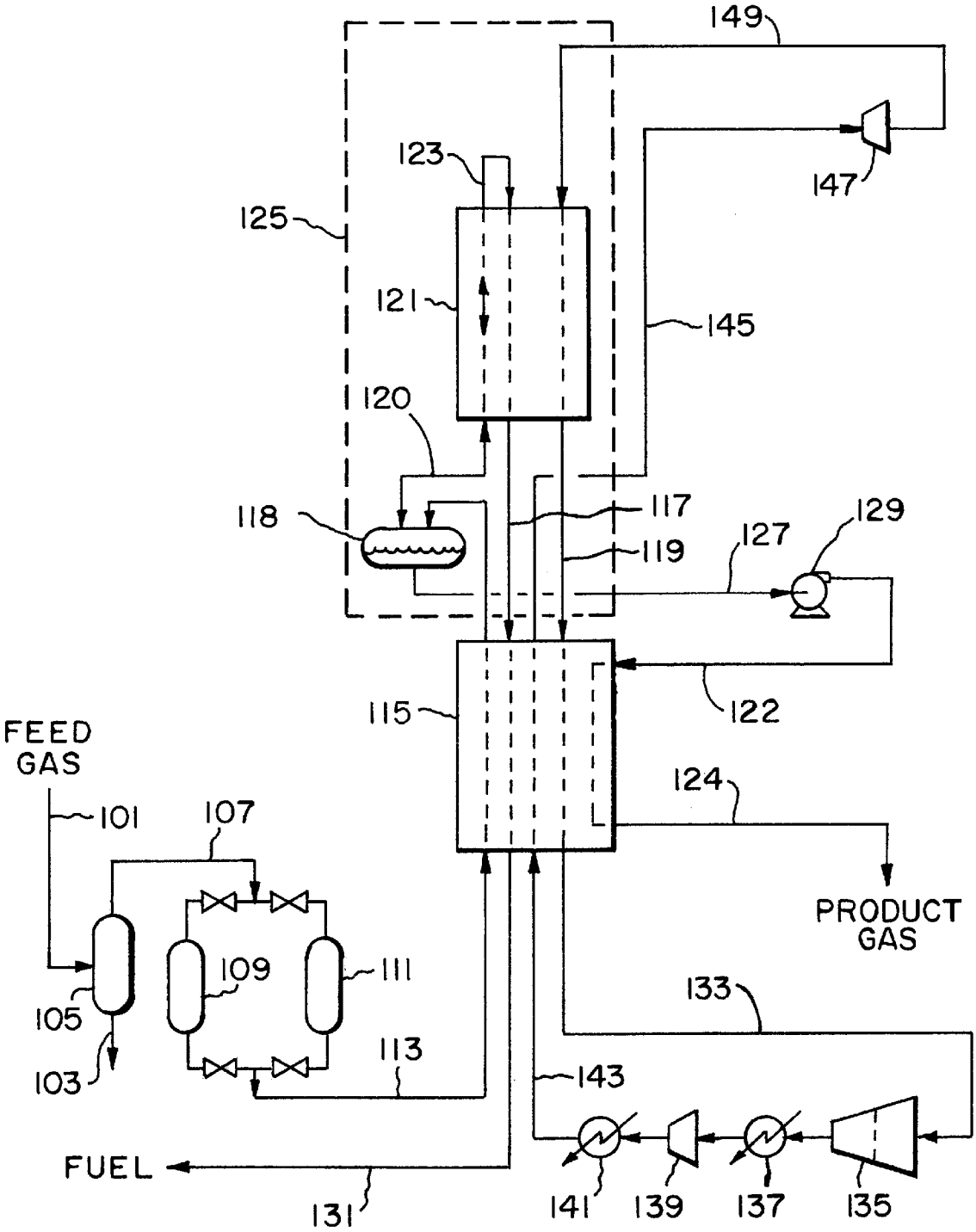
FIG. 1 is a schematic flow diagram of an embodiment of the present invention.

A first embodiment of the invention is shown in FIG. 1. Feed gas in line 101 is a typical cracked gas, fluid catalytic cracker offgas, or fluid coker offgas containing predominantly hydrogen, methane, ethane, and ethylene, with smaller amounts of propane, propylene, and heavier hydrocarbons. The feed gas, typically provided at ambient temperature and pressures in the range of 75–500 psia, can be cooled (not shown) to condense water and other easily-condensible components, which are withdrawn via line 103 from knockout drum 105. Feed gas in line 107 is dried in switching driers 109 and 111 to yield dried feed gas in line 113 typically at a dew point below about −40° F.

Dried feed gas in line 113 is cooled in feed cooling heat exchanger 115 against warming refrigerant and process streams via lines 117, 119, and 122 (later defined) to a temperature in the range of 0 to −100° F. The feed gas, which may be partially condensed in heat exchanger 115, is introduced into drum 118. Uncondensed vapor is withdrawn from drum 118 via line 120, further cooled, condensed, and rectified in dephlegmator heat exchanger 121 to yield light overhead gas in line 123 and bottom liquid which is returned to drum 118 via line 20. Drum 118 and heat exchanger 121 are the main components of a dephlegmator, which can be any type of rectifying heat exchanger and separator system known in the art. Generic condensing and fractionation system 125 can be a dephlegmator as defined above, or alternatively can be any other type of cooling and fractionation process such as a partial condenser or a reboiled and/or refluxed distillation column.

Liquid in line 127, which is enriched in $C_2$ and/or $C_3$ hydrocarbons, is withdrawn from drum 118 and optionally pumped by pump 129 to provide the process stream in line 122 earlier described. Liquid in line 122 is vaporized in heat exchanger 115 to provide a portion of the refrigeration for cooling feed stream 113, and vaporized product gas is withdrawn therefrom via line 124 and sent to further processing to recover ethylene and/or propylene.

Light overhead gas in line 123, typically at a temperature in the range of −100 to −240° F., is warmed in heat exchanger 121 to provide a portion of the refrigeration required therein, and the partially warmed stream in line 117 is further warmed to provide a portion of the refrigeration in heat exchanger 115 for cooling feed gas in line 113 as earlier described. Final warm overhead gas in line 131, containing mostly methane and hydrogen, can be utilized as fuel in related processes.

The additional refrigeration required for feed cooling heat exchanger 115 and dephlegmator heat exchanger 125 is provided by a closed-loop gas expander refrigeration process cycle which preferably uses nitrogen as the working refrigerant fluid. Other low-boiling gases such as methane, a mixture of methane and nitrogen, or air can be used for the refrigerant if desired. In the closed-loop refrigeration process, warm nitrogen in line 133 is compressed in compressor 135, cooled in intercooler 137, further compressed to 500 to 1500 psia in final compressor stage 139, and cooled to near ambient temperature in aftercooler 141. Compressed refrigerant in line 143 is cooled to a temperature in the range of 0 to −120° F. in feed cooling heat exchanger 115 and the resulting cooled refrigerant in line 145 is work expanded in turboexpander 147 to a pressure in the range of 100 to 1000 psia, thereby yielding a cold refrigerant stream in line 149 in the temperature range of −110 to −250° F. Cold refrigerant in line 149 is warmed in heat exchangers 121 and 115 to provide the required refrigeration as earlier described, and the resulting warmed refrigerant in line 133 is compressed to continue the closed loop refrigeration cycle.

The expansion work generated by turboexpander 147 can be used to drive one stage of compressor 135 or 139 (not shown) to improve the overall efficiency of the refrigeration cycle.

Figure 2:
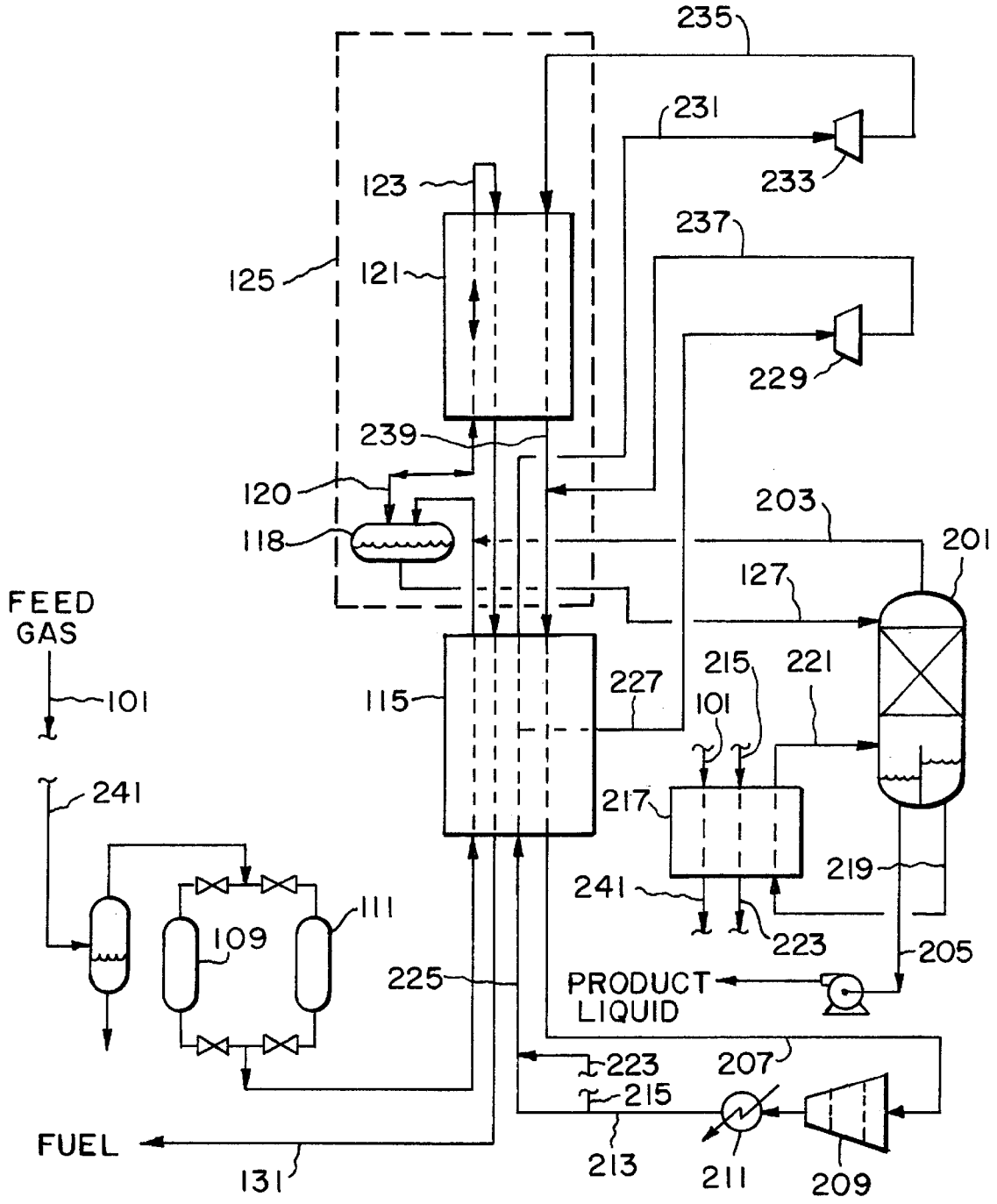
FIG. 2 is a schematic flow diagram of an alternative embodiment of the present invention.

An alternative embodiment of the invention is illustrated in FIG. 2. In this embodiment, the closed-loop gas expander nitrogen refrigeration process utilizes two work expansion steps at different temperature levels, and the dephlegmator liquid is further separated in an integrated stripping column to yield a liquid product further enriched in propane and propylene. Referring to FIG. 2, liquid in line 127 from drum 118 is introduced into stripping column 201 from which lighter components ethane, ethylene, and methane are withdrawn in overhead line 203. Liquid bottoms in line 205, which is further enriched in propane and propylene, is withdrawn and sent to further processing. Overhead in line 203 is combined with the cooled feed gas from heat exchanger 115 and the combined stream is introduced into drum 118 and dephlegmator heat exchanger 121.

Warm nitrogen in line 207 is compressed in multistage compressor 209 and cooled in aftercooler 211 to yield compressed nitrogen refrigerant in line 213. A portion 215 of the compressed nitrogen can be cooled in reboiler heat exchanger 217 against liquid bottoms from line 219 to provide boilup vapor via line 221 for stripping column 201. Cooled nitrogen in line 223 is combined with the remaining compressed nitrogen and combined cooled nitrogen in line 225 is introduced into heat exchanger 115. After cooling in heat exchanger 115 to an intermediate temperature of about −20 to +80° F., portion 227 of the intermediate cooled nitrogen stream is withdrawn and work expanded in turboexpander 229. The remaining compressed nitrogen is further cooled in heat exchanger 115 to −80 to +20° F. and work expanded in turboexpander 233.

Expanded and cooled nitrogen in line 235, now at −100 to −180° F. and 100 to 1000 psia, is warmed in heat exchanger 121 to provide refrigeration as earlier described. Expanded and cooled nitrogen in line 237, now at 0 to −100° F. and 100 to 1000 psia, is combined with warmed nitrogen in line 239, and the combined stream is further warmed to provide refrigeration in heat exchanger 115 as earlier described.

Additional heat for generating boilup vapor in stripping column 201 can be provided by cooling the feed gas from line 101 in reboiler heat exchanger 217 and returning the cooled feed gas via line 241 for processing as earlier described.

Alternatives to the embodiment described above are possible. For example, a distillation column with stripping and rectification sections and overhead condenser can be used to increase product recovery instead of integrated stripping column 201 earlier described. However, it is usually more cost effective to utilize a stripping column only and return the stripped vapor stream to the feed dephlegmator to recover the residual product in that stream.

A similar process can be used to recover ethylene and/or ethane, which may require colder refrigeration temperature levels than those described above. In this case, it may be desirable to utilize additional nitrogen expanders to meet the refrigeration requirements of the separation process in a more energy efficient manner. Nitrogen could be expanded to three or more temperature levels from one or more pressure levels and might also be returned to the compressor at multiple pressure levels. Alternatively, if the hydrocarbon product is recovered as a vapor, a significant amount of refrigeration can be recovered from the vaporization of the recovered liquid and it may be possible to eliminate one or more of the expanders.

Alternative flow schemes are possible for the nitrogen refrigeration systems of FIGS. 1 and 2 which may result in lower power requirements and/or lower capital cost, depending on the particular requirements for refrigeration at various temperature levels. These refrigeration requirements are determined primarily by the feed gas pressure and composition as well as the level of product recovery and purity required. For example, nitrogen refrigerant could be expanded to a higher pressure level in one of the expanders and returned to the compressor at an intermediate pressure level. Alternatively, the nitrogen could be withdrawn from the compressor at an intermediate stage, cooled separately, and expanded in one of the expanders to the lowest pressure level or to another intermediate pressure level.

Two dephlegmators can be utilized in series, for example, to recover a $C_3$-rich product from the warmer dephlegmator and a $C_2$-rich product from the colder dephlegmator. This arrangement might also utilize three expanders to provide refrigeration most efficiently to the feed cooler and two dephlegmators. One or two stripping columns could be added to remove lighter impurities from one or both products. The stripped vapor streams would preferably be returned to the dephlegmators to increase product recoveries.

Additional distillation columns can be integrated into the process to remove heavy hydrocarbons from the $C_2^+$ or $C_3^+$ product, either prior to rectification in the dephlegmator or downstream of the stripping column. If a higher level of light impurities can be tolerated in the hydrocarbon product stream, the stripping column can be eliminated as in the embodiment of FIG. 1. A partial condenser can also be utilized in place of a dephlegmator. However, this will result in significantly higher levels of light impurities in the recovered product and will increase the quantity of refrigeration required and the size of the stripping column if one is required.

Two embodiments of the invention are illustrated in the following Examples.

EXAMPLE 1

FIG. 1 shows the nitrogen refrigerated cryogenic separation process with a single refrigerant gas expander described above. This process is utilized for the recovery of ethylene and ethane vapor from the off-gas of a fluid catalytic cracking (FCC) unit.

Feed gas in line 101 has a flow rate of 787 lbmoles per hour and a composition (mole % basis) of 12.4% hydrogen, 11.4% nitrogen, 38.9% methane, 18.3% ethylene, 15.5% ethane, and 3.5% propane and heavier hydrocarbons. The feed gas, obtained at 113° F. and 152 psia, is pretreated (not shown), dried in driers 109 and 111, and cooled in feed cooling heat exchanger 115 to −85° F. This cooling partially condenses the feed gas stream to yield a condensed portion of 47 lbmoles per hour having a composition of 23.5 mole % ethylene and 35.7 mole % ethane. The partially condensed stream is then introduced into drum 118, and uncondensed vapor is withdrawn from drum 118 via line 120 at a flow rate of 740 lbmoles per hour with a composition of 18.0 mole % ethylene and 14.2 mole % ethane.

The vapor then flows through line 120 to dephlegmator heat exchanger 121 in which it is cooled to −207° F. and rectified to yield a light overhead gas in line 123 and a $C_2$-enriched bottoms liquid at 268 lbmoles per hour containing 48.4 mole % ethylene and 39.2 mole % ethane, which flows back via line 120 into drum 118. The $C_2$-enriched liquids condensed in the feed cooling heat exchanger 115 and dephlegmator heat exchanger 121 are combined in drum 118, withdrawn therefrom via line 127, and pumped to 162 psia in pump 129 to provide pressurized liquid in line 122, which is vaporized in feed cooling exchanger 115 to provide most of the refrigeration required therein. $C_2$ -enriched product gas is withdrawn from feed cooling exchanger 115 via line 124 at 315 lbmoles per hour and contains 44.7 mole % ethylene, 38.6 mole % ethane, and 8.9 mole % $C_3^+$ at 40° F. and 160 psia.

The light overhead gas stream is withdrawn via line 123 from dephlegmator heat exchanger 121 at 472 lbmoles per hour and contains less than 0.6% ethylene and essentially no ethane. The stream is warmed to 40° F. in dephlegmator heat exchanger 121 and feed cooling heat exchanger 115 for refrigeration recovery, and then flows to the plant fuel system via line 131.

The remainder of the refrigeration required for the cryogenic separation process is supplied by the closed-loop nitrogen recycle refrigeration system. Low pressure nitrogen in line 133 at 1940 lbmoles per hour, 46° F., and 165 psia is compressed to 795 psia in nitrogen compressor 135 and final compressor stage 139, and cooled to 104° F. in cooler 141. The high pressure nitrogen in line 143 is then cooled to −110° F. in the feed cooling heat exchanger 115, the cooled high pressure nitrogen in line 145 is work expanded to −224° F. and 175 psia in turboexpander 147, and the expanded, cooled stream 149 is sent to dephlegmator heat exchanger 121 to provide refrigeration therein. The expanded warmed nitrogen stream in line 119 is then further warmed to 46° F. in feed cooling heat exchanger 115 and is recycled via line 133 to the nitrogen compressor.

This process recovers 98.0% of the ethylene and essentially 100% of the ethane and heavier components in the feed gas as a product gas in line 124, which contains less than 8 mole % methane and lighter impurities.

EXAMPLE 2

A nitrogen refrigerated cryogenic separation process for the recovery of a propylene-rich liquid product from the off-gas from a fluid catalytic cracking (FCC) or deep catalytic cracking (DCC) unit is illustrated with reference to FIG. 2. Feed gas flows through line 101 at 2178 lbmoles per hour with a composition of 13.2 mole % hydrogen, 6.0% nitrogen, 31.4% methane, 33.7% ethylenelethane, 10.9% propylene and 4.8% propane and heavier ($C_3^+$) hydrocarbons, at 104° F. and 110 psia. The feed is pre-cooled in stripping column reboiler 217, returned via line 241, dried in driers 109 and 111, and is further cooled to −40° F. and partially condensed in the feed cooling heat exchanger 115. The partially condensed stream, which contains a condensed liquid portion of 179 lbmoles per hour containing 37.8 mole % propylene and 39.9 mole % $C_3^+$, is combined with vapor stream 203 from stripping column 201 and the combined stream flows into drum 118.

The uncondensed vapor flows via line 120 from drum 118 into dephlegmator heat exchanger 121 where it is cooled to −109° F. and rectified to produce a light overhead gas stream withdrawn via line 123 and a propylene-enriched bottom liquid at 364 lbmoles per hour containing 57.3% propylene and 10.5 mole % $C_3^+$. This bottoms liquid flows back through line 120 into drum 118. The total vapor in line 120 which is rectified in the dephlegmator is 2201 lbmoles per hour containing 9.6% propylene and 1.7 mole % $C_3^+$. The propylene-enriched liquids condensed in the feed cooling heat exchanger 115 and dephlegmator heat exchanger 121 are withdrawn from drum 118 via line 127 and sent to stripping column 201 to remove ethylene and lighter components. A propylene-rich liquid product at 341 lbmoles per hour containing 68.9% propylene and 30.7 mole % $C_3^+$ is recovered from the bottom of stripping column 201 via line 205 at 58° F. and 100 psia and is pumped to 350 psia for further processing. The light overhead vapor from stripping column 201 flows via line 203 at 202 lbmoles per hour containing 20.4 mole % propylene and 5.1 mole % $C_3^+$ is returned to the dephlegmator for rectification to recover the residual propylene in the vapor as earlier described. The light overhead gas from dephlegmator heat exchanger 121 flows through line 123 at 1837 lbmoles per hour and contains less than 0.2% propylene. The overhead gas is warmed to 86° F. in dephlegmator heat exchanger 121 and feed cooling heat exchanger 115 for refrigeration recovery, and is sent to the plant fuel system via line 131.

Most of the refrigeration required for this cryogenic separation process is supplied by a closed-loop nitrogen refrigeration system. Low pressure nitrogen flows through line 207 at 6300 lbmoles per hour, 86° F., and 249 psia, and is compressed to 800 psia in multi-stage nitrogen compressor 209 and cooled in cooler 211 to 104° F. A portion of the compressed nitrogen inline 213 can be sent via line 215 for cooling in stripping column reboiler 217 to supplement feed cooling if necessary and returned via line 223. Compressed nitrogen flows through line 225 into feed cooling heat exchanger 115 and is cooled to an intermediate temperature of 60° F.

A portion of this nitrogen, 1850 lbmoles per hour, is withdrawn via line 227, work expanded to −71° F. and 254 psia in warm expander 229, combined with another nitrogen stream (later defined), and flows to feed cooling heat exchanger 115 to provide refrigeration therein. The remainder of the nitrogen, 4450 lbmoles per hour, is further cooled to −40° F. in feed cooling heat exchanger 115, flows via line 231 to cold expander 233, is expanded to −146° F. and 259 psia, and flows via line 235 to dephlegmator heat exchanger 121 to provide refrigeration therein. Warmed nitrogen in line 239 from dephlegmator heat exchanger 121 is combined with the expanded nitrogen in line 237 and the combined stream is warmed to 86° F. in feed cooling heat exchanger 115 to provide refrigeration therein. Warmed nitrogen returns via line 207 to nitrogen compressor 209 as earlier described. The work generated by nitrogen expanders 229 and 233 preferably is used to drive two stages of compressor 209 (not shown).

This process recovers 98.7% of the propylene and essentially 100% of the propane and heavier components in the feed gas as a liquid product via line 205 containing less than 0.4 mole % ethylene and lighter impurities.

The present invention provides a low cost and energy efficient process to recover one or more hydrocarbons selected from ethane, ethylene, propane, propylene, and higher molecular weight hydrocarbons if present from gas streams such as refinery or petrochemical off-gases which contain these components with hydrogen and possibly other light components. The process utilizes a low cost and energy-efficient method to supply the refrigeration required for condensation and rectification of the feed gas.

The nitrogen recycle system can supply refrigeration at any required temperature level, but supplies it most efficiently and economically in the range of about −50° F. to about −250° F. At this low temperature level, very high $C_2$ and $C_3$ recovery is possible even with relatively low pressure feed gases, and feed compression typically is not required. The nitrogen refrigerated process can achieve much higher product recovery than prior art processes which utilize work expansion of feed gas or light residue gas, in which case product recovery is limited by the refrigeration available between the feed gas inlet pressure and the residue gas delivery pressure.

The process of the present invention has a lower capital cost than processes which utilize mixed refrigerant systems or conventional cascade refrigeration systems because of the low cost and high efficiency of nitrogen compressors and expanders as compared to hydrocarbon compression equipment. Also, no refrigerant drums are required because the nitrogen is not condensed in the process. No complex refrigerant make-up systems are required because nitrogen is usually available in most refinery and petrochemical facilities for use as inert gas or for purging of equipment.

Since the nitrogen refrigerant is typically maintained above 100 psia throughout the process, pressure drop losses are small compared to hydrocarbon refrigerants which are generally vaporized at much lower pressures for refrigeration. Typically the nitrogen is compressed to at least 600 psia, preferably at least 800 psia, to provide the most energy-efficient process. Higher pressures can be even more energy-efficient, but the power savings must be evaluated against the additional cost of higher pressure equipment.

The present process also has a lower capital cost than processes which utilize absorption for hydrocarbon recovery, since those processes require multiple distillation columns to absorb and strip the hydrocarbon product from the absorption solvent, in addition to any columns required to remove light or heavy impurities. Also, external refrigeration is usually required to refrigerate the solvent in order to achieve high $C_2$ recovery.

The essential characteristics of the present invention are described completely in the foregoing disclosure. One skilled in the art can understand the invention and make various modifications without departing from the basic spirit of the invention, and without deviating from the scope and equivalents of the claims which follow.

What is claimed is:

1. A process for the separation of a feed gas mixture comprising hydrogen and one or more components selected from the group consisting of ethane, ethylene, propane, and propylene, which process comprises:

(a) cooling the feed gas mixture;

(b) introducing the resulting cooled feed gas mixture into a cooling and fractionation zone wherein the cooled feed gas mixture is further cooled and fractionated to yield a light overhead gas stream and a liquid product stream enriched in one or more components selected from the group consisting of ethane, ethylene, propane, and propylene; and (c) providing at least a portion of the refrigeration required in (a) and (b) by indirect heat exchange with a cold refrigerant stream generated by work expanding a pressurized gaseous refrigerant stream in a closed-loop gas expander refrigeration process.

2. The process of claim 1 wherein the cooling and fractionation of the cooled feed gas mixture in (b) is performed in a dephlegmator.

3. The process of claim 1 wherein a portion of the refrigeration required in the cooling and fractionation zone of (b) is provided by indirect heat exchange with the light overhead gas stream of (b) to yield a warmed light overhead gas stream.

4. The process of claim 3 wherein a portion of the refrigeration required for cooling the feed gas mixture in (a) is provided by indirect heat exchange with the warmed light overhead gas stream.

5. The process of claim 1 wherein a portion of the refrigeration required for cooling the feed gas mixture is provided by indirect heat exchange by at least partially vaporizing the liquid product stream of (b).

6. The process of claim 1 wherein the pressurized gaseous refrigerant stream of (c) is provided in the closed-loop gas expander refrigeration process which comprises compressing a warmed refrigerant gas resulting from providing at least a portion of the refrigeration required in (a) and (b), cooling the resulting compressed refrigerant gas, and work expanding the resulting cooled compressed refrigerant gas to provide the cold refrigerant stream of (c).

7. The process of claim 6 wherein the refrigerant gas comprises nitrogen, methane, a mixture of nitrogen and methane, or air.

8. The process of claim 6 wherein a portion of the work required to compress the warmed refrigerant gas is provided by the work expanding of the resulting cooled compressed refrigerant gas.

9. The process of claim 6 wherein a portion of the refrigeration required for cooling the resulting compressed refrigerant gas is provided by indirect heat exchange by at least partially vaporizing the liquid product stream of (b).

10. The process of claim 1 wherein at least a portion of the refrigeration required in (a) and (b) is provided in a closed-loop gas expander refrigeration process which comprises:

(1) compressing a warmed refrigerant gas resulting from providing at least a portion of the refrigeration required in (a) and (b);

(2) cooling the resulting compressed refrigerant gas to yield a cooled refrigerant gas;

(3) further cooling a first portion of the cooled refrigerant gas to yield a further cooled refrigerant gas which is work expanded and used to provide a portion of the refrigeration required in (b), thereby yielding a partially warmed refrigerant gas; and (4) work expanding a second portion of the cooled refrigerant gas to yield a cooled expanded refrigerant gas, combining the cooled expanded refrigerant gas with the partially warmed refrigerant gas of (3), and utilizing the resulting combined refrigerant gas to provide a portion of the refrigeration required to cool the feed gas mixture in (a), thereby providing the warmed refrigerant gas of (1).

11. The method of claim 1 which further comprises introducing at least a portion of the liquid product stream of (b) into a stripping column and withdrawing therefrom a bottoms stream further enriched in one or more components selected from the group consisting of ethane, ethylene, propane, and propylene and an overhead stream enriched in hydrogen.

12. The method of claim 11 wherein the overhead stream is combined with the cooled feed gas mixture prior to the cooling and fractionation in (b).

13. The method of claim 11 wherein boilup vapor for the stripping column is provided at least in part by vaporizing liquid from the bottom of the column by indirect heat exchange with the feed gas mixture, thereby cooling the feed gas mixture.

14. The method of claim 11 wherein boilup for the stripping column is provided at least in part by vaporizing liquid from the bottom of the column by indirect heat exchange with a portion of the pressurized gaseous refrigerant stream, thereby cooling the portion of the pressurized gaseous refrigerant stream.

15. The method of claim 1 wherein the feed gas mixture further comprises one or more lower-boiling components selected from the group consisting of methane, carbon monoxide, carbon dioxide, and nitrogen.

* * * * *